United States Patent [19]

Hirahara et al.

[11] Patent Number: 4,560,329

[45] Date of Patent: Dec. 24, 1985

[54] STRAINER DEVICE FOR ROTARY COMPRESSOR

[75] Inventors: Takuho Hirahara; Fumiaki Sano, both of Shizuoka; Koji Ishijima, Fujieda; Susumu Kawaguchi; Kazuhiro Nakane, both of Shizuoka, all of Japan

[73] Assignee: Mitsubishi Denki Kabushiki Kaisha, Tokyo, Japan

[21] Appl. No.: 620,831

[22] Filed: Jun. 15, 1984

[30] Foreign Application Priority Data

Oct. 20, 1983 [JP] Japan ..... 58-196525

[51] Int. Cl.[4] ..... F04C 18/00; F04C 29/00

[52] U.S. Cl. ..... 418/47; 418/63; 417/902; 55/378

[58] Field of Search ..... 418/47, 63; 417/902; 55/373, 378, 438, 439

[56] References Cited

U.S. PATENT DOCUMENTS

| | | | |
|---|---|---|---|
| 1,769,153 | 7/1930 | Meyer | 418/47 |
| 2,094,323 | 9/1937 | Kenney et al. | 417/902 |
| 2,274,942 | 3/1942 | Touborg | 417/902 |
| 2,446,194 | 8/1948 | Samiran | 418/47 |
| 2,468,948 | 5/1949 | Smith | 417/902 |
| 3,016,183 | 1/1962 | Murphy et al. | 418/63 |
| 3,689,203 | 9/1972 | Vaughn | 417/902 |

FOREIGN PATENT DOCUMENTS

| | | | |
|---|---|---|---|
| 2355181 | 1/1978 | France | 418/47 |
| 57-186087 | 11/1982 | Japan . | |

*Primary Examiner*—John J. Vrablik

*Attorney, Agent, or Firm*—Oblon, Fisher, Spivak, McClelland & Maier

[57] ABSTRACT

A strainer device for a rotary type compressor includes a rolling piston which rotates with rotation of a rotational shaft, a cylinder plate provided in correspondence to the direction of the outer periphery of the rolling piston, a pair of side plates supporting the rotational shaft, and disposed on both side surfaces of the cylinder plate to define a compression chamber. A suction pipe passes through a shell housing with one end thereof being connected with a suction port formed in one of the side plates to introduce intake gas. A communication path leads the intake gas from the suction port to the compression chamber and a strainer removes foreign substances contained in the intake gas, the strainer being provided in a path formed in the cylinder plate or the side plate, not in the suction pipe, through which the intake gas flows.

6 Claims, 9 Drawing Figures

STRAINER DEVICE FOR ROTARY COMPRESSOR

This invention relates to a rotary compressor to be incorporated in a refrigerating or air-conditioning apparatus. More particularly, it is concerned with an improved arrangement of the strainer within a flow path of intake gas into such apparatus.

FIG. 1 of the accompanying drawing illustrates a cross-section of the main part of a compression mechanism in a conventional rotary compressor as disclosed, for example, in a Japanese Unexamined Patent Publication No. 186087/1982. In the drawing, a reference numeral 1 designates a cylinder plate, and numerals 2 and 3 refer to side plates which define a suction and compression chamber 4. A rotational shaft 5 is driven by an electric motor, etc. (not shown in the drawing) to decrease and increase a volume in the above-mentioned suction and compression chamber 4 by means of a rolling piston 5*a*, thereby performing compression of the intake gas. Foreign substances, if any, in the intake gas are removed by a strainer 7 which is disposed at an enlarged portion 6*a* of a suction pipe 6 which is provided through a shell housing 10 as a pressure container, and the thus filtered intake gas is introduced into the suction and compression chamber 4 by way of a suction port 8 formed in the side plate 2 and a communication path 9 formed in the cylinder plate 1.

The above-described strainer device, however, has such disadvantages that it requires complicated working steps of enlarging a diameter of the suction pipe at its one portion, then disposing the strainer 7 in the enlarged portion of the suction pipe, and thereafter squeezing the open end of the enlarged portion 6*a*, and that stringent working precision is required in forming the pipe to meet the necessity for close and tight attachment of the strainer 7 at and to this enlarged portion 6*a* of the suction pipe 6.

The present invention has been made with a view to removing such disadvantages as mentioned above inherent in the conventional strainer device, and aims at providing an improved rotary compressor, wherein the strainer is provided in the cylinder plate or the side plate, instead of its being installed in the suction pipe, thereby dispensing with any complicated working steps to be effected on the suction pipe.

It is another object of the present invention to provide an improved strainer device for the rotary compressor, in which an open end of the communication path formed in the cylinder plate to the side of the side plate is enlarged in its diameter, and a fitting for caulking the strainer is placed in this enlarged portion, thereby making it unnecessary to effect diameter-expanding and contracting works on the suction pipe and also making it possible to effect assembly of the strainer in the compressor with ease.

According to the present invention, in general aspect of it, there is provided a strainer device for a rotary compressor which comprises: a rolling piston which rotates with rotation of a rotational shaft; a cylinder plate provided in correspondence to the direction of the outer periphery of said rolling piston; a pair of side plates rotatably supporting said rotational shaft, and being disposed on both side surfaces of said cylinder plate to define a compression chamber; a suction pipe passing through a shell housing and with one end thereof being communicatively connected with a suction port formed in one of said side plates to introduce intake gas such as coolant gas, etc.; a communication path for leading said intake gas from said suction port to said compression chamber; and a strainer for removing foreign substances contained in the intake gas, said strainer being provided in the path formed in said cylinder plate or side plate, through which the intake gas flows.

The foregoing objects, other objects as well as specific construction and function of the strainer device for the rotary type compressor according to the present invention will become more apparent and understandable from the following detailed description of several preferred embodiments thereof, when read in conjunction with the accompanying drawing.

In the drawing

In the following, the present invention will be described in detail with reference to the preferred embodiments thereof illustrated in the accompanying drawing.

Figure 3:
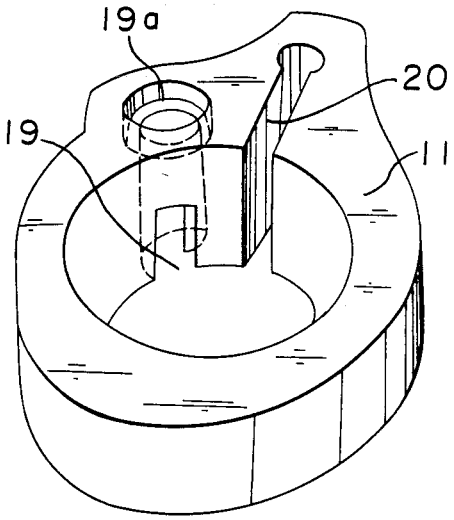
FIG. 3 is an enlarged perspective view of the cylinder plate of the rotary compressor shown in FIG. 2.
Figure 1:
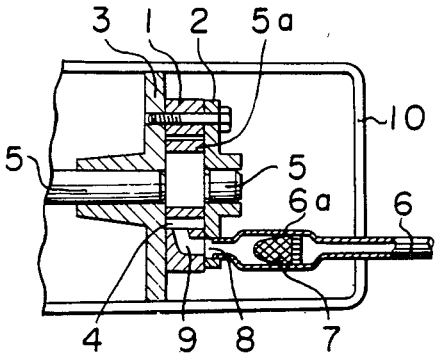
FIGURE 1 PRIOR ART
FIG. 1 is a cross-sectional view showing a strainer device of a conventional rotary type compressor.
Figure 2:
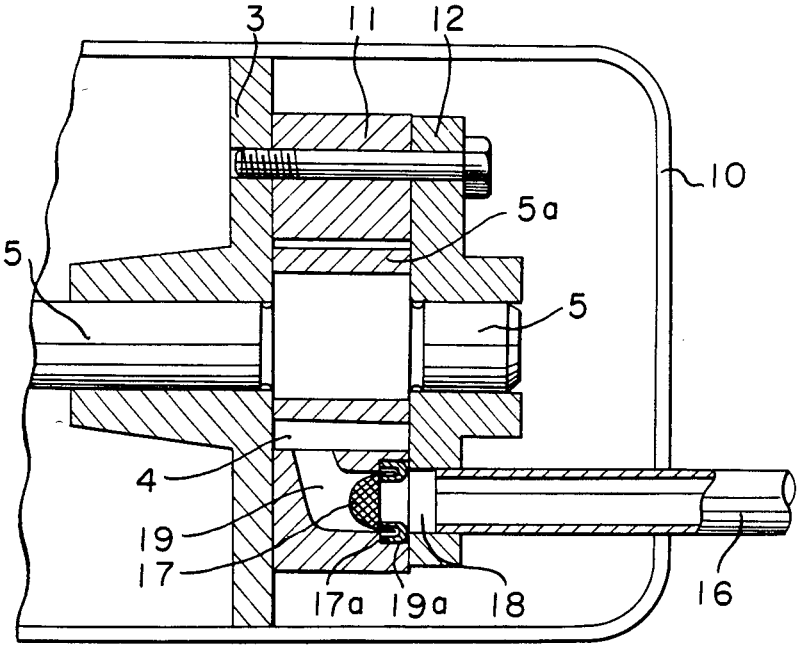
FIG. 2 is a cross-sectional view showing a strainer device for the rotary type compressor according to the first embodiment of the present invention.

Referring first to FIGS. 2 and 3 showing respectively the cross-sectional view of the main part of the strainer device according to the first embodiment of the present invention and a perspective view of the cylinder plate, those parts designated by the reference numerals 1 through 10 inclusive denote the identical or equivalent parts as those in FIG. 1. In the drawing, a numeral 11 refers to the cylinder plate. As is clearly seen from the drawing, an enlarged diameter (or diameter-increased) portion 19*a* is formed at one open end of the communication path 19 to the side of the side plate 12. Within the enlarged portion 19*a*, there is embedded a caulking fitting 17*a* as a fitting to constitute the peripheral rim of the cup-shaped strainer 17, the caulking having a diameter larger than the communication path 19. The suction pipe 16 is a straight tube extending in the axial direction of the rotational shaft 5, with one end thereof being connected with the suction port in the side plate 12. The pipe does not have the enlarged portion 6*a* as in the conventional device shown in FIG. 1. Incidentally, a reference numeral 20 in FIG. 3 designates a vane groove, into which a vane (not shown in the drawing) is fitted to define the compression chamber and the suction chamber.

In the strainer device of the above-described construction according to the first embodiment of the present invention, foreign substances which have got mixed in the intake gas such as coolant gas, etc. are removed by the strainer 17, and the thus filtered gas alone is introduced into the suction and compression chamber 4, whereby the same function as has ever been done can be attained. In addition, the working on the suction pipe can be done very easily, since it is the straight tube as already mentioned in the foregoing, and the assembly of the strainer 17 can also be done very easily only by inserting the caulking fitting 17*a* into the diameter-increased portion 19*a* of the communication path 19 formed in the cylinder plate 11. In this manner, according to the first embodiment of the present invention, since the caulking fitting 17*a* for the strainer 17 is embedded in the enlarged portion 19*a* of the communication path 19 in the cylinder plate 11, the working of the suction pipe 16 and the fitting of the strainer 17 can be simplified very remarkably.

Figure 4:
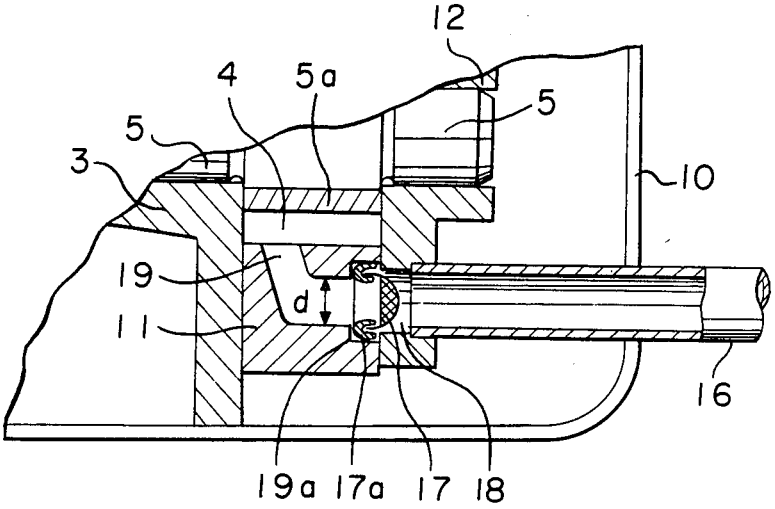
FIG. 4 through 8 are respectively cross-sectional views showing the second to sixth embodiments of the strainer device according to the present invention.

In the following, the second embodiment of the strainer device according to the present invention will be explained in reference to FIG. 4. In this second embodiment shown in FIG. 4, the construction of the strainer device is exactly same as that of the first embodiment shown in FIG. 2 with the exception that the fitting direction of the strainer 17 is reversed.

Figure 5:
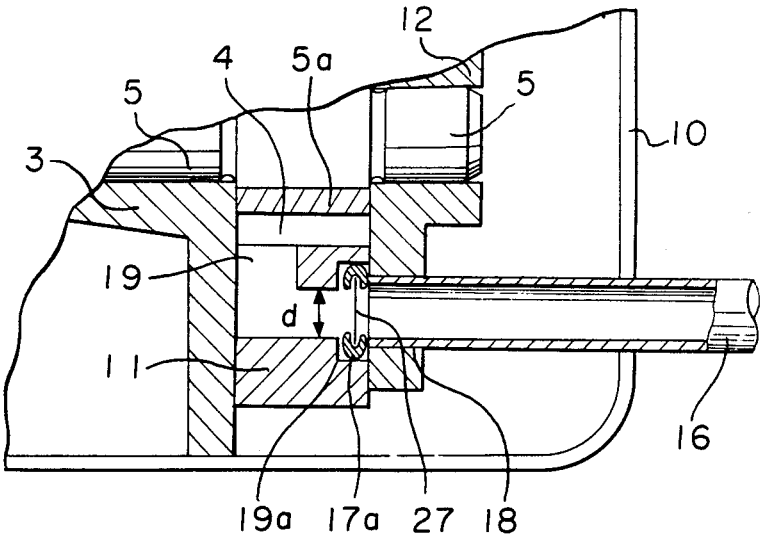

FIG. 5 shows the third embodiment of the present invention, wherein a flat-shaped strainer 27 is fitted. In either of the second and third embodiments, the diameter d of the communication path 19 formed in the cylinder plate 11 can be made small, whereby rigidity of the cylinder plate 11 can be improved advantageously.

Figure 6:
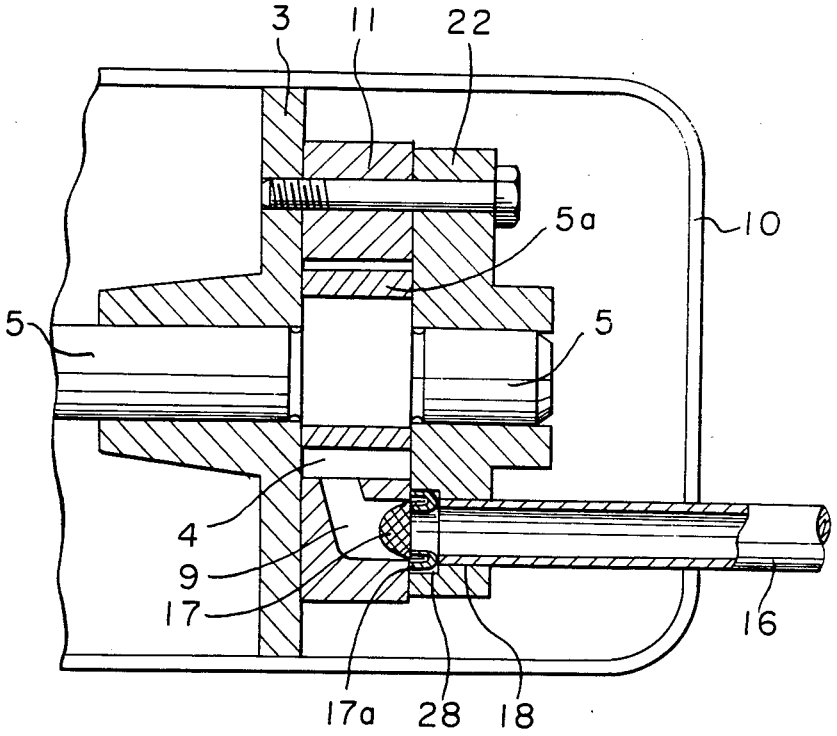

In the following, the fourth embodiment of the present invention will be explained in reference to FIG. 6. In FIG. 6, those reference numerals same as in FIGS. 2 to 5 designates the identical or equivalent parts. In this particular embodiment, the position for setting the strainer is selected in the side plate. In the drawing, a reference numeral 28 designates an enlarged portion of the suction port 18 formed in the side plate 22. In this enlarged portion 28, the caulking fitting 17*a* constituting the peripheral rim of the strainer 17 is embedded. Same as in the previous embodiments, the suction pipe 16 is a straight tube extending in the axial direction of the rotational shaft 5, one end of which is connected with the suction port 18 formed in the side plate 22. Accordingly, there is no enlarged portion 6*a* as in the conventional device shown in FIG. 1.

In the strainer device of the above-described construction according to the fourth embodiment of the present invention, foreign substances which have got mixed in the intake gas such as coolant gas, etc. can be removed by the strainer 17, as is the case with the first embodiment, and the thus filtered gas alone is introduced into the suction and compression chamber 4, whereby the same function which has ever been done can be attained. In addition, working of the suction pipe 16 is extremely easy due to its being a straight tube, and the assembly of the strainer 17 can also be completed simply by insertion of the caulking fitting 17*a* into the enlarged portion 28 of the suction port 18 in the side plate 22, hence this embodiment has the same effect as the first embodiment of the present invention.

In the following, the fifth and sixth embodiments of the strainer device according to the present invention will be explained in reference to FIGS. 7 and 8.

Figure 7:
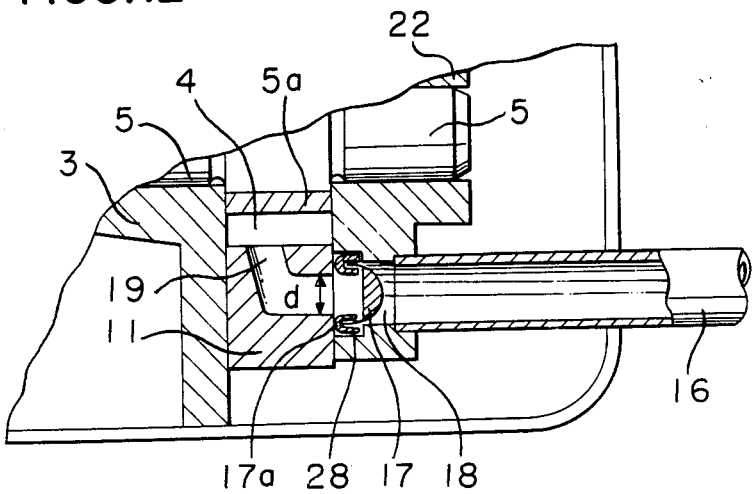
Figure 8:
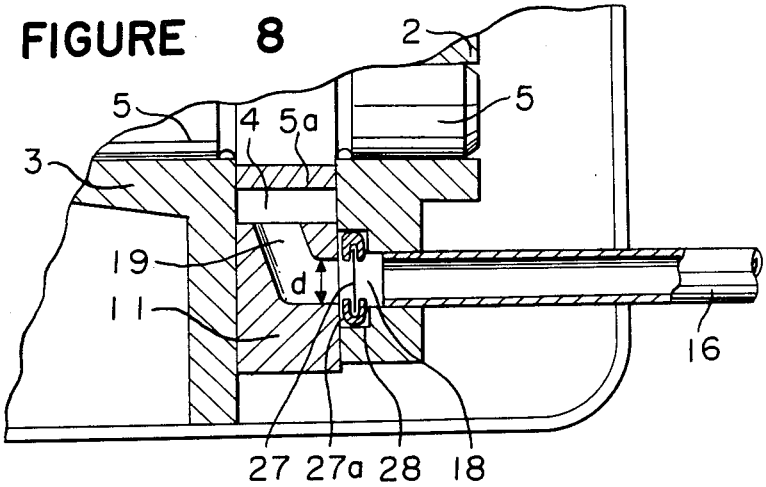

FIG. 7 is a cross-sectional view of the main part of the strainer device according to the fifth embodiment of the present invention, wherein the fitting direction of the strainer 17 is reversed in contrast to the embodiment shown in FIG. 6. FIG. 8 illustrates the sixth embodiment of the present invention, wherein the flat-shaped strainer 27, same as that in FIG. 5, is fitted. In either of the fifth and sixth embodiments, the diameter d of the communication path 19 formed in the cylinder plate 11 can be made small, whereby rigidity of the cylinder plate 11 can be improved advantageously in the same manner as mentioned in the foregoing.

Figure 9:
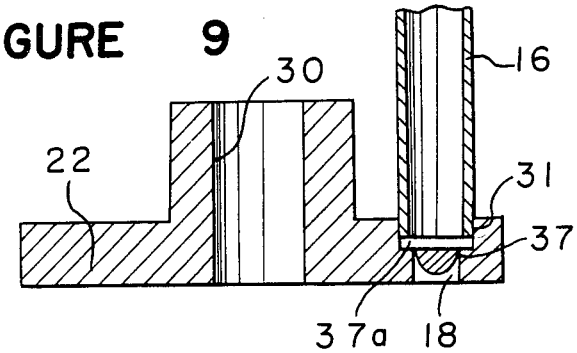
FIG. 9 is a cross-sectional view of the main part of the strainer device according to the seventh embodiment of the present invention.

In the following, the seventh embodiment of the strainer device according to the present invention will be explained in reference to FIG. 9 which illustrates a cross-sectional view of the main part of the strainer device including the side plate 22 and the suction pipe 16 same as the fourth embodiment shown in FIG. 6. In this particular embodiment, the strainer is provided at a position opposite the cylinder plate. In FIG. 9, the same reference numerals as in FIG. 6 designate the identical or equivalent parts to those in the previous figure of the drawing. A reference numeral 30 designates a bearing for the rotational shaft, a numeral 31 refers to a suction pipe fitting port having a large-diameter portion, and a numeral 37 refers to a strainer having a fitting portion 37*a* around its peripheral rim, the strainer being set in the suction port with a small diameter next to the large diameter portion. In this embodiment, a part of the suction pipe fitting port 31 in the side plate 22 is made a strainer accommodating chamber, and the strainer 37 is inserted in its interior and fixed at its position by pushing the suction pipe 16 into the pipe fitting port. In this manner, the enlarging and contracting works on the suction pipe required for forming the strainer chamber in the enlarged portion 6*a* of the suction tube 6 as has been done heretofore become unnecessary, whereby the same effect as in the foregoing embodiments can be exhibited.

As has been explained in the foregoing, the present invention provides the strainer in the cylinder plate or the side plate, instead of providing it within the suction pipe. As the consequence of this, there are various advantages such that no complicated workings are required for disposing the strainer within the suction pipe, and that the disposition of the strainer can be done simultaneously with the assembly of the side plate and the suction pipe, whereby assembly of the strainer device as a whole can be simplified, and the manufacturing cost of the strainer device can be reduced.

While specific embodiments of the present invention have been shown and described, it will be apparent that to those persons skilled in the art that various changes, modifications, substitutions, additions, and omissions may be made therein without departing from the spirit and scope of the invention as set forth in the appended claims.

We claim:

1. A strainer device for a rotary type compressor, which comprises, in combination:

a rotational shaft;

a rolling piston which rotates with rotation of said rotational shaft;

a cylinder plate provided in correspondence to the direction of the outer periphery of said rolling piston;

a pair of side plates supporting said rotational shaft, and being disposed on both side surfaces of said cylinder plate to define a compression chamber;

a shell housing;

a suction pipe passing through said shell housing with one end thereof being connected with a suction port formed in one of said side plates to introduce intake gas;

a communication path for leading said intake gas from said suction port to said compression chamber, said communication path including an enlarged diameter portion in one of said cylinder plate and said side plate, said enlarged diameter portion having one end defined by a joint between said cylinders plate and said side plate; and a strainer for removing foreign substances contained in the intake gas, said strainer being provided in said enlarged diameter portion, said strainer having a caulking fitting larger than said communication path and fitting into said enlarged diameter portion so as to fix said strainer in position.

2. The strainer device for the rotary type compressor according to claim 1, wherein said suction pipe is constructed in a substantially rectilinear form over its entire length.

3. The strainer device for the rotary type compressor according to claim 1, wherein said suction pipe is disposed substantially in parallel with the axial direction of said rotational shaft, on which said piston is provided.

4. The strainer device for the rotary type compressor according to claim 1, wherein said enlarged diameter portion is formed in said cylinder plate.

5. The strainer device for the rotary type compressor according to claim 1, wherein said enlarged portion is formed in said side plate.

6. The strainer device for the rotary type compressor according to claim 4 or 5, wherein said strainer is in one of a cup-shape and a flat-shape.

* * * * *